US010874198B2

(12) United States Patent
Fischer et al.

(10) Patent No.: US 10,874,198 B2
(45) Date of Patent: Dec. 29, 2020

(54) SUPPORT STRUCTURE

(71) Applicant: Mammut Sports Group AG, Seon (CH)

(72) Inventors: Andreas Fischer, Muhlau (CH); Julian Langer, Bern (CH)

(73) Assignee: Mammut Sports Group AG, Seon (CH)

( * ) Notice: Subject to any disclaimer, the term of this patent is extended or adjusted under 35 U.S.C. 154(b) by 0 days.

(21) Appl. No.: 16/165,104

(22) Filed: Oct. 19, 2018

(65) Prior Publication Data

US 2019/0125061 A1 May 2, 2019

(30) Foreign Application Priority Data

Oct. 26, 2017 (DE) ..... 10 2017 219 211

(51) Int. Cl.
*A45F 3/08* (2006.01)
*A45F 3/04* (2006.01)

(52) U.S. Cl.
CPC ..... *A45F 3/08* (2013.01); *A45F 2003/045* (2013.01)

(58) Field of Classification Search
CPC ..... A45F 3/08; A45F 2003/045; A45F 3/047; A45F 3/04; A45F 3/10; A45F 2003/146; A45F 3/06; A45F 2003/122; A62B 9/04
USPC ..... 224/634, 637
See application file for complete search history.

(56) References Cited

U.S. PATENT DOCUMENTS 2,886,031 A * 5/1959 Robbins ..... A61F 5/024 602/19
4,189,076 A * 2/1980 Zufich ..... A45F 3/08 224/631
5,954,250 A * 9/1999 Hall ..... A62B 9/04 224/262
5,954,253 A 9/1999 Swetish
6,637,631 B2 * 10/2003 Lafoux ..... A45F 3/047 224/197
8,182,439 B2 * 5/2012 Glenn ..... F41H 1/02 224/637
8,991,671 B2 * 3/2015 Gill ..... A45F 3/08 224/628
9,629,443 B2 * 4/2017 Searle ..... A45F 3/08
9,918,540 B2 * 3/2018 Fawcett ..... A45F 3/00
(Continued)

FOREIGN PATENT DOCUMENTS

AT 503417 A4 10/2007
DE 10228388 A1 1/2004

*Primary Examiner* — Adam J Waggenspack
(74) *Attorney, Agent, or Firm* — The Webb Law Firm

(57) ABSTRACT

The present invention relates to a support structure for a rucksack, including a support framework having a first and a second bearing point arranged at a spacing from one another along a first direction, and a first and a second rotation element. The first rotation element is mounted on the support framework at the first bearing point and is rotatable about a first rotation axis and the second rotation element is mounted on the support framework at the second bearing point and is rotatable about a further rotation axis. The first and second rotation elements are constructed for receiving a shoulder belt and hip belt, respectively, in a torsion-resistant manner. The first and the second rotation element are rotationally coupled to one another in a manner reversing the direction of rotation.

8 Claims, 5 Drawing Sheets

(56) References Cited

U.S. PATENT DOCUMENTS

| | | | | |
|---|---|---|---|---|
| 10,230,077 | B2 * | 3/2019 | Rief | H01M 2/1005 |
| 10,368,626 | B2 * | 8/2019 | Roque | A45F 3/08 |
| 2008/0197163 | A1 * | 8/2008 | Yip | A45F 3/047<br>224/635 |
| 2014/0061263 | A1 * | 3/2014 | Flem | A45F 3/08<br>224/261 |

* cited by examiner 1
10
95
96
96
96
91
92
93
94
94
12
3
13
7
71
72
73
731
732
732
732
5
51
52
53
531
532
12
120
121
122
126
3
132
131
13
136

SUPPORT STRUCTURE

CROSS-REFERENCE TO RELATED APPLICATION

This application claims priority to German Patent Application No. 10 2017 219 211.9 filed Oct. 26, 2017, the disclosure of which is hereby incorporated in its entirety by reference.

BACKGROUND OF THE INVENTION

Field of the Invention

The present invention relates to a support structure, in particular for a rucksack, comprising: a support framework having a first and a second bearing point, wherein the first and second bearing points are arranged at a spacing from one another along a first direction; and a first and a second rotation element, wherein the first rotation element is mounted on the support framework at the first bearing point such that it is rotatable about a first rotation axis extending substantially transversely to the first direction, and the second rotation element is mounted on the support framework at the second bearing point such that it is rotatable about a second rotation axis extending substantially parallel to the first rotation axis, wherein the first rotation element is constructed for fastening at least one shoulder belt extending substantially along the first direction and the second rotation element is constructed for fastening at least one hip belt extending substantially transversely to the first direction and to the first and second rotation axes.

Such support structures can be used in particular in rucksacks.

Description of Related Art

It is already known to provide support structures for rucksacks, wherein the hip belt and the shoulder belts are rotatably fastened to a support framework, wherein the bearing arrangement brings about a return to the starting position via a restoring force. This additional degree of freedom increases the wearing comfort over that of rigid structures. Such a structure is known for example from AT 503 417. However, it is disadvantageous that the wearer has to expend energy to work against the restoring force.

SUMMARY OF THE INVENTION

It is an object of the present invention to provide a support structure which further increases the wearing comfort.

Accordingly, a support structure is proposed, which has a support framework with a first and a second bearing point, wherein the first and second bearing point are arranged at a spacing from one another along a first direction. A first rotation element is mounted at the first bearing point, a second rotation element is mounted at the second bearing point. The first rotation element is rotatable about a first rotation axis extending substantially transversely to the first direction. Within the context of the present invention, the expression "substantially transversely" should be understood to mean that the angle can be ca. 80° to 100°. In relation to the wearer of the support structure, the first rotation axis extends substantially parallel to the dorsal and ventral direction. The second rotation element is mounted such that it is rotatable about a second rotation axis extending substantially parallel to the first rotation axis. The expression "substantially parallel" here should also be understood to mean that the directions can be strictly parallel but do not have to be strictly parallel; rather, an angle between the directions can be up to 10°, for example. The first rotation element is constructed for fastening at least one shoulder belt, in particular for receiving said shoulder belt in a torsion-resistant manner, which shoulder belt extends substantially along the first direction near to the rotation element. The shoulder belt can extend along a direction which forms an angle of up to 30° with the first direction. The second rotation element is constructed for fastening at least one hip belt, in particular for receiving said hip belt in a torsion-resistant manner, which hip belt extends substantially transversely to the first direction and transversely to the first and second rotation axes. The hip belt can therefore also deviate from the geometrical transverse direction to R by up to 30°, for example.

The object is now achieved in that the first and the second rotation element are rotationally coupled to one another in a manner reversing the direction of rotation.

Within the context of the present invention, the expression "rotationally coupled to one another in a manner reversing the direction of rotation" should be understood to mean a coupling between the rotation elements which transmits a rotation movement of the one rotation element to the other rotation element in such a way that the two rotation elements rotate with an opposite direction of rotation. It could also be said that the rotation elements coupled in this way counter-rotate or rotate towards one another. The coupling is therefore constructed in a manner reversing the rotation, as it were, or "transmits a counter rotation".

The invention is based on the recognition that, when walking, a direction of rotation of the lateral hip tilt—i.e. a direction of rotation of the flexion or anterior rotation and the extension or posterior rotation of the pelvis—and a direction of rotation of the tilting movement of the shoulder girdle—i.e. a direction of rotation of the depression or lowering of the shoulder girdle on one side and/or the flexion or raising on the other side of the shoulder girdle—are opposed, and that this characteristic of human anatomy can be advantageously accommodated by a support structure having a shoulder- and hip-belt mounting which is rotationally coupled in a manner reversing the direction of rotation.

The rotation elements, which are rotationally coupled to one another in a manner reversing the direction of rotation, preferably rotate substantially simultaneously and/or in each case through a substantially identical rotation angle.

The support framework is constructed for example as a frame or plate. As a frame, the framework can be constructed from or with a central longitudinal support on which the bearing points are provided. For optimum integration in a rucksack, side brackets projecting to the side of the longitudinal support can be provided, which can be constructed in particular in a U or W shape and therefore absorb the lateral forces which occur during use of the rucksack. However, it is also conceivable that the support framework itself is constructed merely from a longitudinal support or a U-shaped support or an annularly closed frame, a plate or at least part of a rear wall of a rucksack or the like.

The support structure here can be integrated in particular in a rucksack or be devised for such a rucksack. However, it is of course also conceivable that the support structure is used otherwise by a wearer for carrying loads. The support structure can serve for example as a back frame for a portable vacuum cleaner or other loads.

The rotation elements can be plate-like single- or multi-piece elements.

In a preferred first exemplary embodiment, the support structure further comprises an elongated, preferably rod-shaped bending element as a rotational coupling device for rotationally coupling the first and second rotation element in a manner reversing the direction of rotation.

Both or one of the rotation elements can also be constructed in one piece with the bending element.

The bending element preferably reaches along a connecting line extending from the first to the second rotation axis or, in other words, the bending element extends towards the rotation axes with its end portions. In the starting position (with a relaxed, straight bending element), the bending element extends for example along the connecting section between the rotation axes. If the rotation elements are pivoted, the bending element is bent and extends substantially along a curve between the two rotation axes.

In a further development, the bending element can be mounted on one of the first and second rotation elements in a fixed manner and mounted on the other of the first and second elements such that it is displaceable along the first direction and fixed transversely thereto (i.e. for transmitting the rotation movement). This helps to bridge the longer curve compared to the connecting section between the rotation axes. To this end, the rotation element can have, for example, blind holes or through-holes extending transversely to the rotation axis, in which the bending element is inserted. In this case, on one side, it can be anchored, for example bonded, in the rotation element in a fixed manner. On the other side, it can slide in and out of this hole with an optimum lateral arrangement which enables a good lateral force transmission by means of which the rotation movement is transmitted from the one rotation element to the other. However, it is also conceivable that the change in length is ensured by a length adaptation of the bending element.

In a preferred second exemplary embodiment, the support structure further comprises two or more tension- and/or pressure-resistant connecting elements, which are each fastened at a spacing from the first rotation axis at a first fastening point on the first rotation element and at a second fastening point on the second rotation element. The first and second fastening point each lie on opposite sides with respect to a straight connecting line through the first and second rotation axes. If a plurality of connecting elements are present, these can therefore cross, which brings about the reversal of the direction of rotation. If a plurality of connecting elements are provided, these preferably cross in the region of the straight connecting lines.

The one, two or more tension- and/or pressure-resistant connecting elements are preferably selected from the group comprising cables, wires and rods. The rods can also be described as poles. The connecting elements can have a flexible and/or stretchable construction. These connecting elements can also be rigid. If cables are provided, the use of at least two connecting elements is advisable. The connecting elements can be made from metal, in particular light metal, plastics material and/or natural materials.

A lateral spacing of the fastening points from the respective rotation axes is selected such that the acting levers enable a comfortable rotation transmission without jamming or dead points.

In a preferred third exemplary embodiment, the first and second rotation elements are designed with first and second fingers projecting towards one another, wherein free ends of the first and second fingers are connected to one another via a joint. These fingers are preferably each portions of a plate-shaped rotation element. Such a plate-shaped rotation element having a finger projecting substantially cranially or caudally (in relation to the wearer) can have further laterally projecting fingers on which the corresponding belt is fastened.

According to a preferred further development, at least one of the first and second rotation elements is displaceable along the first direction in various sliding positions for length adaptation of the support structure and can be fixed in place there with respect to the longitudinal direction R (i.e. no longer movable along R but rotatable there). Latching mechanisms can be provided for this purpose. For example, a central longitudinal support can have a series of holes arranged along the first direction or an elongated hole arranged in such a manner, wherein the displaceable rotation element is seated on a slide which is mounted to be displaceable along the longitudinal support. A bolt can then further be provided, which can engage in the hole to fix the slide in place in a locking position and permits the slide movement along R in a release position. Alternatively to the design with a bolt, it is also conceivable that the slide has clamping jaws and can therefore be clamped on the longitudinal support. Other guide and bearing means are likewise conceivable.

The said connecting elements can be elastic or mounted in elongated holes; the joint of the third embodiment can likewise be formed via an elongated hole in order to realize the length adjustability.

In a further development, one or more stop elements are provided, which limit a rotation of the first and/or the second rotation element. A stop element is preferably provided for each rotation element. The stop element provides one, preferably two, stop surfaces which are preferably arranged symmetrically on both sides of the straight connecting lines through the rotation points. A rotation angle with respect to the straight connecting lines through the first and second rotation axes is preferably limited to 15°, particularly preferably to 10° or less. These stop elements provide at least one, preferably two, stop surfaces. For example, a bracket which is mounted on the support framework in a fixed manner can be positioned around a finger of the rotation element so that the finger abuts laterally against the bracket when the limit angle is reached. However, it is also conceivable that the corresponding rotation element has a preferably curved longitudinal slot, wherein a pin which is fixed with respect to the support framework engages in this slot and wherein the pin strikes against a slot end when the limit angle is reached and thus blocks the further rotation.

A support structure comprising at least one, preferably precisely two, shoulder belts and at least one, preferably precisely one, hip belt is particularly preferred.

The present invention also relates to a rucksack having such a support structure.

In one aspect, therefore, the present invention relates to the use of a support structure according to the invention, in particular for a rucksack. The support structure comprises a support framework having first and second rotatably mounted rotation elements arranged at a spacing from one another along a first direction, on which rotation elements the shoulder belts or the hip belt are fastened and which rotation elements are rotatably mounted in the support framework, wherein the first and the second rotation element are rotationally coupled to one another in a manner reversing the direction of rotation. The support structure therefore adapts naturally to the shoulders or hips, which, when the wearer is walking, rotate in mutually opposite directions about the first and second rotation axis or axes parallel thereto and, via the belts, serve as bearing points for the support structure carried on the shoulders. The support structure in this case can be constructed as described herein.

BRIEF DESCRIPTION OF THE DRAWINGS

Preferred embodiments of the invention are described below with reference to the drawings, which merely serve for explanation and should not be interpreted as being restrictive. The drawings show.

DESCRIPTION OF THE INVENTION

Preferred embodiments are now described with reference to FIGS. 1 to 12.

Figures 1, 2:
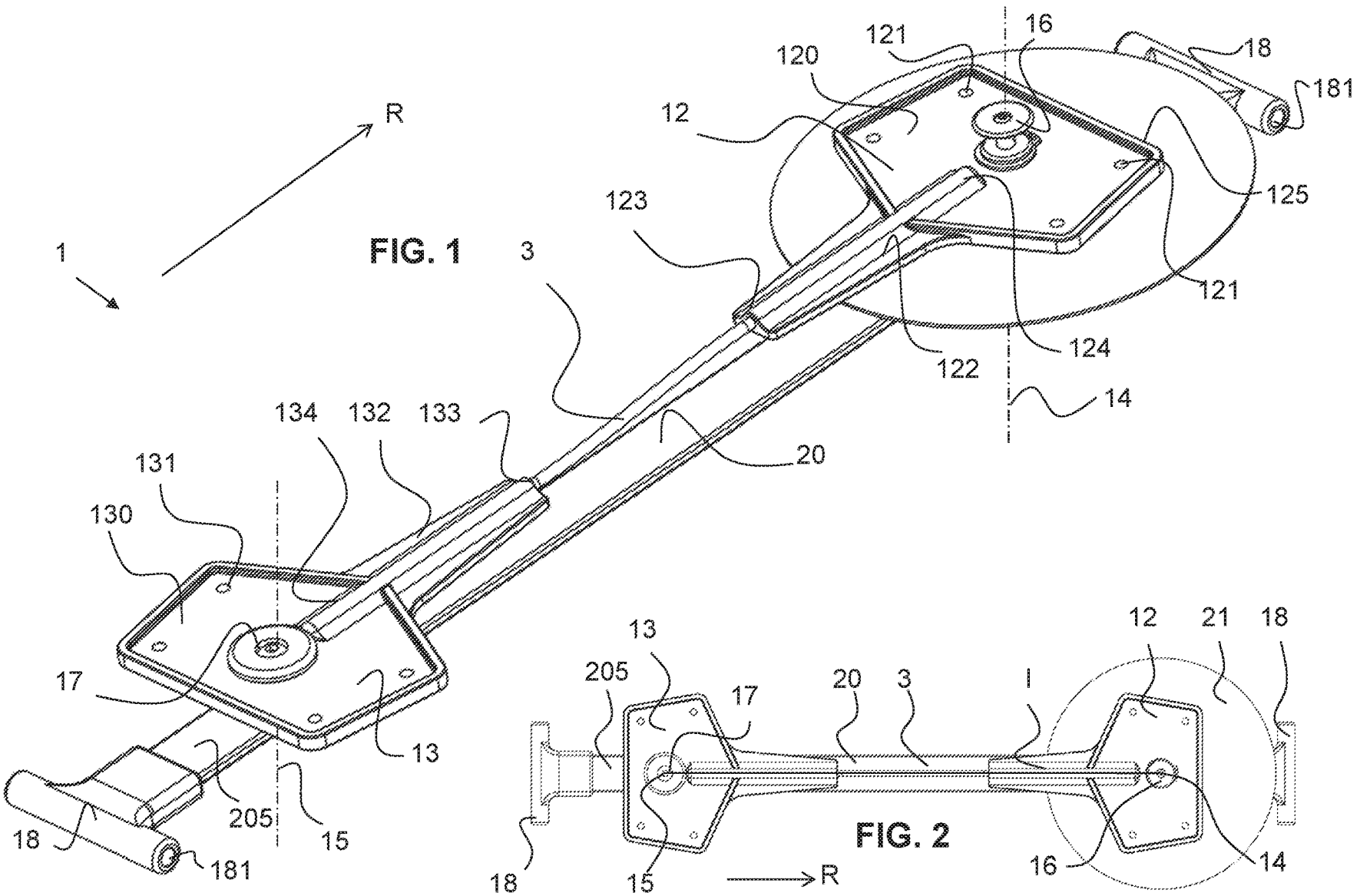
FIG. 1 a perspective view of a preferred first embodiment of the support structure.
FIG. 2 a plan view of the support structure according to FIG. 1.

FIG. 1 shows, in a perspective view, the support structure 1 according to a preferred embodiment. FIG. 2 shows this support structure 1 in a plan view, FIG. 3 in a perspective longitudinal sectional view, FIG. 4 in a longitudinal sectional view. This support structure 1 is suitable for being combined with a rucksack 10 (see FIG. 6).

The support structure 1 comprises a longitudinal support 20. The longitudinal support 20 is constructed as a bending- and torsion-stable flat rod and has a first end portion 206 and a second end portion 205. The longitudinal support 20 can be manufactured from a light metal and/or from plastics material or other materials.

A respective T-shaped connecting element 18 is fitted on both end portions 205, 206 of the longitudinal support 20. The connecting elements can be made from light metal and/or plastics material. In particular, they can be single-part plastics elements which are preferably die cast. An opening for receiving part of the respective end portion 205, 206 is provided at the free end of the vertical portion of the connecting element 18. The horizontal portion of the connecting element 18 has laterally orientated cutouts 181 into which respective portions of brackets 81, 82 (see FIG. 5) are inserted for forming the support framework.

Through-holes are provided in the region of the first and second end portion 206, 205. These through-holes 202, 2050 define a first bearing point 16 and a second bearing point 17. The first and second bearing points 16, 17 are arranged at a spacing from one another along the first direction R, which extends parallel to the longitudinal axis of the longitudinal support 20. Central axes through the through-holes 202, 2050 extending transversely to R extend parallel to a first rotation axis 14 and a second rotation axis 15. A first rotation element 12 is mounted in the through-hole 202 at the first bearing point 16 and a second rotation element 13 is mounted in the second through-hole 2050 at the second point 17 such that they are each rotatable about the respective first and second rotation axis 14 and 15.

The first and the second rotation elements 12, 13 each have a base plate 120, 130 which is substantially rectangular in design. Cutouts 121, 131, which serve for fastening belts 5, 7 in a torsion-resistant manner by means of bolt connections, are provided in the four corner regions. Other fastenings can be provided. The base plates 120, 130 are each provided with a web 125, 135 at the edge, which increases the stability of the rotation element 12, 13 accordingly. The rotation elements can likewise be light metal or plastics elements. Mutually facing lateral edges of the base plates 120, 130 each extend towards one another and are provided centrally with a protruding first finger element 122 and second finger element 132. The first and second finger element 122, 132 is each constructed as a distally tapering flat rod, wherein a cylindrical cover 124, 134 extending along the finger element 122, 132 (i.e. parallel to R when the rotation elements 12, 13 are in the starting position) is provided and wherein cylindrical bores extending centrally along the longitudinal axis of the finger element 122, 132 are provided for receiving a rod element 3. The distal openings 123, 133 leading into the cylindrical blind holes in the finger elements 122, 132 are directed towards one another in the starting position and are pivotable out of this alignment according to a rotation of the respective rotation element 12, 13. Moreover, it can be seen in particular in FIG. 1 that the cylindrical cover 124, 134, which protrudes upwards over the respective base plate 120, 130, reaches almost centrally into the base plate 120 and 130 in the R direction so that the blind holes can have corresponding depths to ensure a stable seat for the rod element 3.

Figure 3:
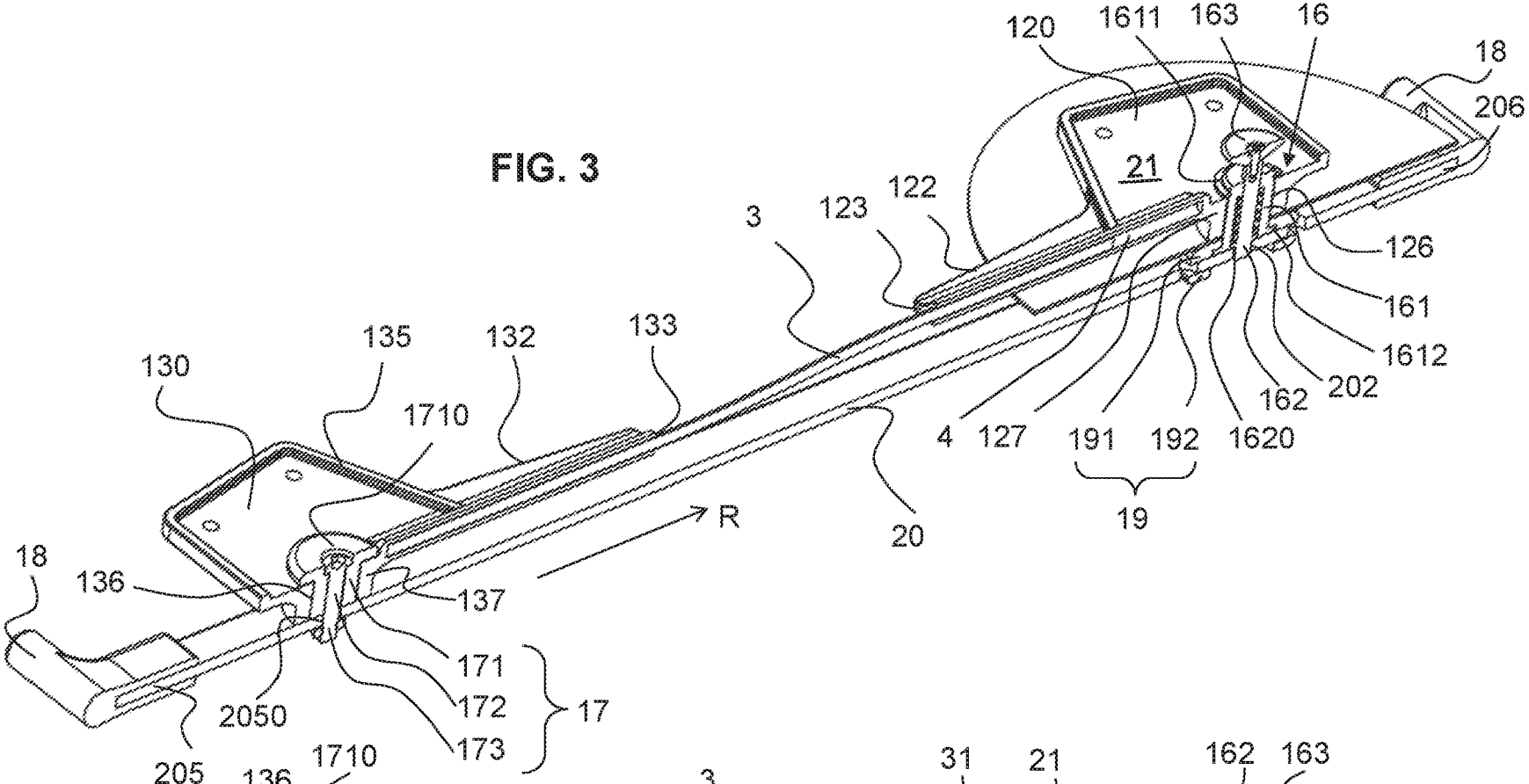
FIG. 3 a perspective longitudinal sectional view of the support structure according to FIG. 1.

Now to the bearing arrangement of the first and second rotation element 12, 13. The first bearing of the first rotation element 12 has a hollow cylindrical body 161, which is seated on the longitudinal support 20 by means of a flange 1612 through a cutout 126 in the base plate 120. At its upper end (as illustrated in FIG. 3), a shaft securing ring 1611 is provided, which lies in a circumferential groove of the hollow cylindrical body 161 and lies on the base plate 120 with the radially protruding portion, whereby the hollow cylindrical body 161 is fixed on the base plate 120 such that is prevented from slipping downwards. The radially protruding flange 1612 is mounted in a slide 19 which lies on the longitudinal support 20 transversely to the longitudinal direction R, whereby the hollow cylindrical body 161 is fixed in place axially.

The slide 9 reaches around the longitudinal support 20 with a first slide element 191 sliding on one flat side of the longitudinal support 20 and a second slide element 192 sliding on the other flat side of the longitudinal support 20, wherein the slide elements 191, 192 are connected to one another in a fixed manner. The slide 19 is designed such that it is displaceable along the longitudinal support 20 in a sliding manner, carrying the hollow cylindrical body 161.

A bolt 162 is provided through the central bore of the hollow cylindrical body 161, which bolt has a longer construction than the hollow cylindrical body 161 and reaches through the longitudinal support and the slide 19. At its lower end region, a circumferential radially protruding bolt flange 1620 is provided for lying on the longitudinal support 20, wherein the diameters of the bolt 162 and flange 1620 are designed such that that region of the bolt 162 which protrudes distally downwards from the flange 1620 engages in the through-hole 202 in the locking position shown in FIG. 3 and the flange 1620 lies on the support 20. In this case, the length of the bolt 162 should be dimensioned so that a lower surface of the longitudinal support 20 and a distal (lower) end face of the bolt 162 are substantially flush in the locking position, i.e. when the flange 1620 is lying on the upper side of the longitudinal support 20.

The central bore is radially widened in the centre region of the hollow cylindrical body 161, wherein a pressure spring 164 is positioned in the hollow cylindrical body 161 between an upper stop surface provided by the comparatively reduced bore diameter and the flange 1620. The pressure spring 164 is supported on the upper stop surface in the central bore and presses the bolt 162 downwards into the locking position as a result of applying pressure to the flange 1620. At its upper end, the bolt 162 has a protruding and manually operable head 163, which is fixed in the bolt 162 via a screw. If this head 163 is now pulled, the pre-tensioned bolt 162, under compression of the pressure spring 164, can be pulled upwards out of the locking position according to FIG. 3 into a release position. If the bolt 162 is located in the release position, then the hollow cylindrical body 161, which is mounted in the slide 19 together with the on the longitudinal support 20, can be displaced on the longitudinal support 20 along the direction R since the bolt 162 no longer engages in the cutout in the support 20. Therefore, length adjustment is thus provided. In the embodiment shown in FIGS. 3 and 4, three different longitudinal positions are provided by the three through-holes 201, 202, 203 arranged at a spacing from one another in the direction R. It is conceivable to provide more or fewer holes or an elongated hole, wherein, in the case of the elongated hole, a clamping of the slide relative to the longitudinal support 20 can be realised in the locking position.

The second rotation element 13 is likewise fixed on the longitudinal support 20 via a hollow cylindrical body 171. The hollow cylindrical body 171 again has an upper flange 1710 with which the hollow cylindrical body 171 lies on the base plate 130, wherein the centre region of the hollow cylindrical body 171 projects downwards through a central opening 136 through the base plate 130 to the longitudinal support 20. A screw 172 is inserted in the central bore of the hollow cylindrical body 171, which screw reaches to below the longitudinal support 20 through the through-hole 2050. Below the longitudinal support 20, the screw 172 has a circumferential groove in which a nut 173 is inserted. The hollow cylindrical body 171 is therefore fixed between the upper flange 1710 and the lower nut 173.

Both rotation elements 12, 13 are moreover formed in such a way that they have downwardly projecting collar elements 127, 137 for lying cylindrically on the hollow cylindrical bodies 161, 171 in an optimum manner, which collar elements are supported on the central portions of the hollow cylindrical bodies 161, 171 for a rotational bearing arrangement. As can be seen in FIG. 3, the first cylindrical collar element 127 of the first rotation element 12 is supported on a disc 21 which is in turn supported on the slide 19. The second cylindrical collar element 137 of the second rotation element 13 lies distally directly on the longitudinal support 20.

Figures 6, 7, 8, 9:
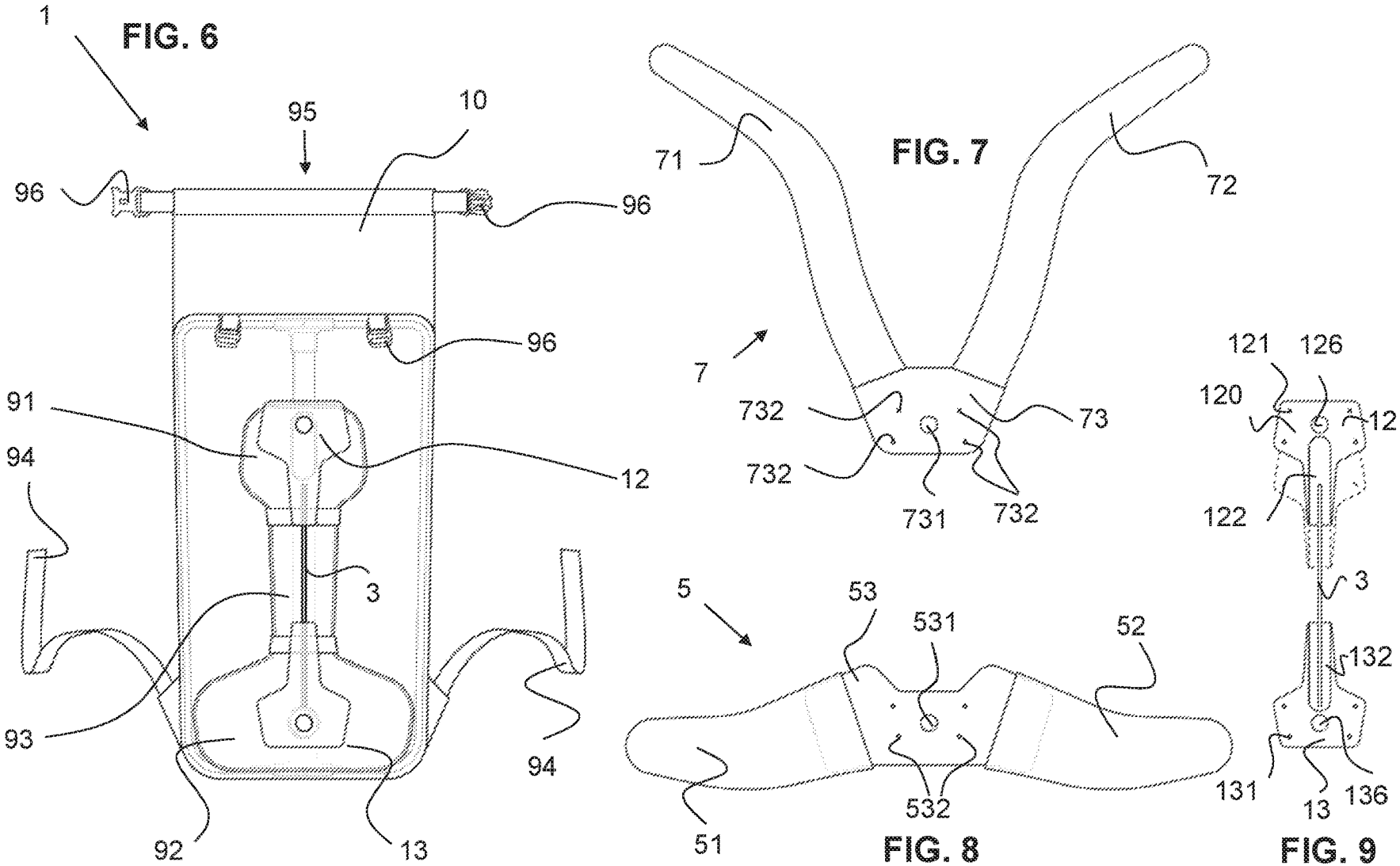
FIG. 6 the support structure according to FIG. 5 with an integrating means for fastening to the rucksack.
FIG. 7 the shoulder belt according to FIG. 5.
FIG. 8 the hip belt according to FIG. 5.
FIG. 9 the rotation elements, which are coupled via a bending rod, in two length adjustments.

Owing to the length adjustability, the support structure 1 can be adapted to the anatomy of the particular wearer, as is depicted in FIG. 9. The starting configuration is shown by continuous lines, a shortened configuration by interrupted lines.

Figure 4:
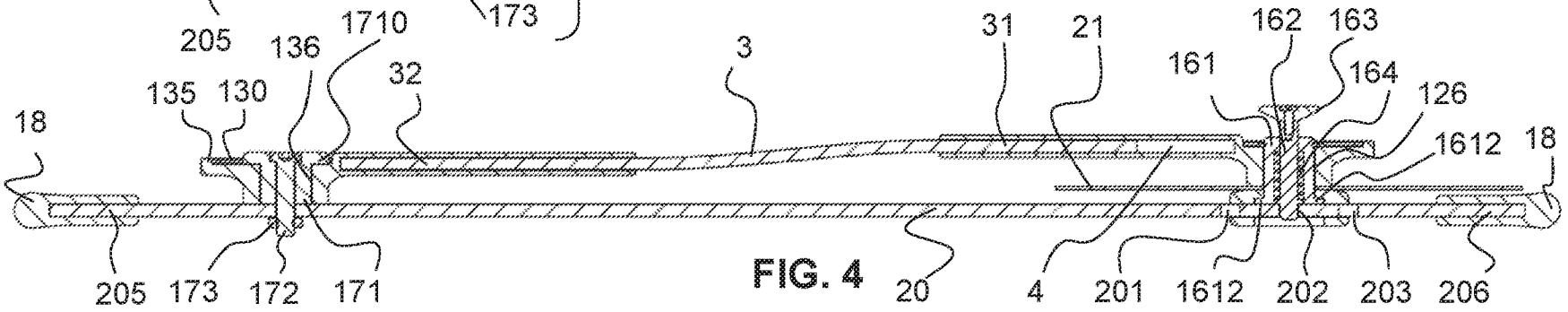
FIG. 4 a longitudinal sectional view of the support concept according to FIG. 1.

It can moreover be seen from FIG. 4 that, by means of an end portion 32, the flexible, inherently stable rod element 3 reaches through the opening 133 to the depth of the cylindrical hole in the second rotation element 13. The second end portion 32 is anchored in the rotation element 13 in a fixed manner, for example via a material-fitting connection or other fastening means. On the other side, the rod element 3 has a first end portion 31, which engages loosely in the cylindrical blind hole of the first rotation element 12 through the opening 123. The first end portion 31 is therefore axially displaceably received in the rotation element 12. This displaceability is possible due to an empty space 4 distally of the end portion 31 and serves for the length adaptation when the first and the second rotation element 12, 13 are rotated. This displaceable bearing moreover enables a length adjustment to be possible, i.e. a spacing between the first and second bearing points 16, 17, as described above (see also FIG. 9). The first end portion 31 is encompassed laterally to transmit the rotation movement.

The rod element 3 is an elastic element, a bending rod here. It can moreover be seen from FIG. 4 that the first end portion 31 is mounted higher than the second end portion 32. Owing to the flexibility of the bending rod 3, this structure-related height-difference can be overcome without difficulty.

The disc 21 serves as a sliding element so that rucksack parts, i.e. rear wall portions, can be received between the longitudinal rod 20 and the disc 21 where a gap is formed, as can be seen from FIG. 4. The corresponding regions of the rucksack 10 which are located around this disc 21 can be removed accordingly so that the length adjustment is possible; they can also have corresponding slots. In this simplest variant, the rucksack wall simply has a longitudinal slot extending along the direction there, which enables the adjustment of the bearing point 16.

Figure 5:
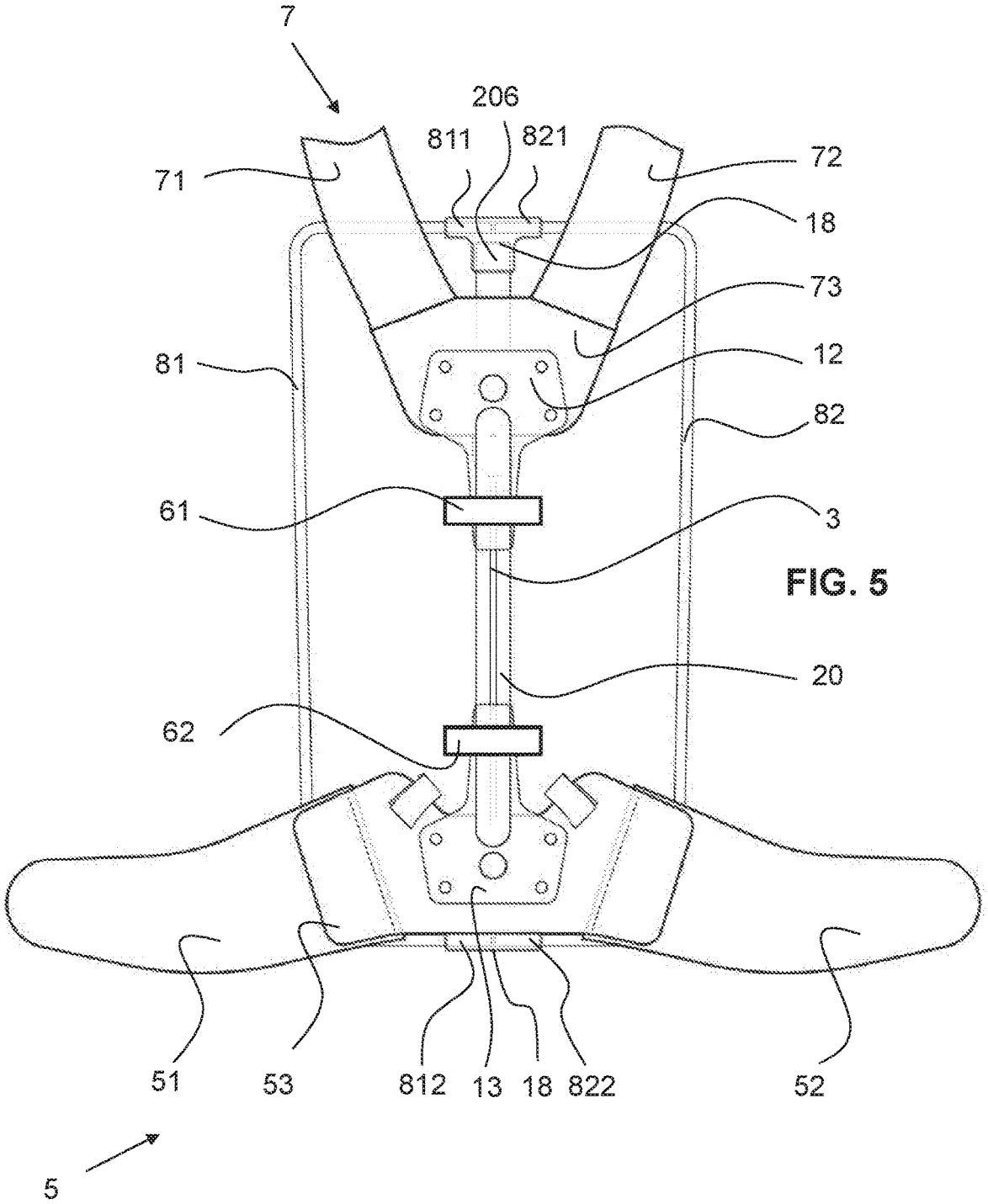
FIG. 5 a plan view of the support structure according to FIG. 1, with shoulder belt, hip belt and bracket frame.

FIG. 5 shows, in a plan view, the assembled support structure 1 having the fitted bracket elements 81, 82. The first and second bracket elements 81, 82 each have a U shape, wherein the free ends 811, 812 and 821, 822 are inserted into the respective cutouts 181 of the connecting elements 18. The longitudinal support 20 and the bracket elements 81, 82 form the frame of the support structure 1.

Figure 10:
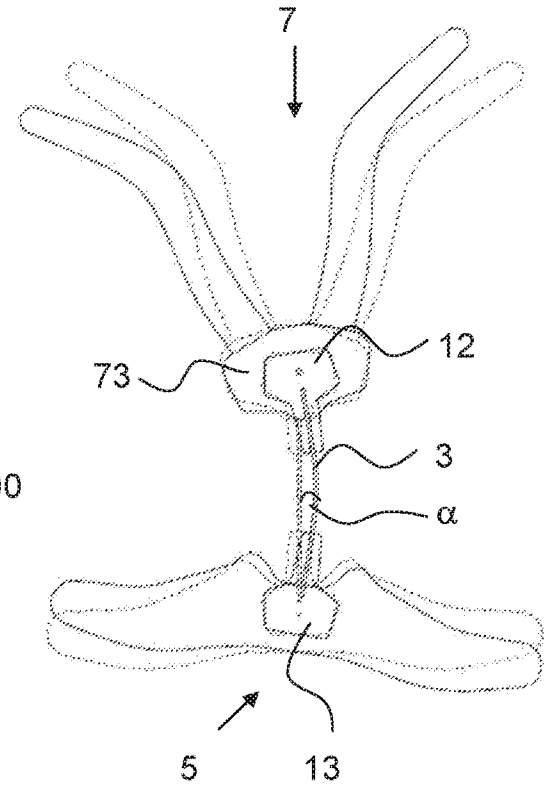
FIG. 10 the support structure according to FIGS. 1 to 9 in an activated bending position and a passive starting position.

It can moreover be seen in FIG. 5 that stop elements 61 and 62 projecting over the finger elements 122, 132 are provided, which provide two symmetrically arranged lateral stop surfaces and therefore limit a rotation of the rotation elements 12, 13 laterally on both sides to a rotation angle $\alpha$ (FIG. 10). These stop elements 61, 62 can be loop bands or brackets.

A shoulder belt base plate 73, from which a first and a second shoulder strap 71, 72 extend, is mounted on the first base plate 120. These shoulder straps 71, 72 extend substantially along the direction R.

A hip belt plate 53, from which hip belt portions 51, 52 extend, is provided on the second base plate 130, which hip belt portions 51, 52 extend transversely to the direction R and to the dorsal direction, i.e. in the lateral direction.

The base plates 53, 73 are each connected to the base plates 120, 130 in a fixed manner. To this end, the base plates 53, 73 have cutouts 532, 732 near to the edge for bolt connections, which are illustrated in FIGS. 7 and 8. Other fastening options are conceivable. The respective central cutout 531, 731 through which the corresponding cylindrical body 161, 171 is guided can moreover be seen in FIGS. 7 and 8.

If one of the rotation elements 12, 13 is now rotated, its rotation movement is transmitted via the bending rod 3 to the other rotation element 13, 12 in a manner reversing the direction of rotation. This is illustrated in FIG. 10, where the bending position is illustrated by continuous lines and the starting position is illustrated by interrupted lines. The bending element 3 therefore produces a rotational coupling between the rotation elements 12, 13 which reverses the direction of rotation. The length compensation owing to the bending of the bending rod 3 is ensured by the sliding of the first end portion 31 in the first rotation element 12.

FIG. 6 shows the integration of the support structure 1 including the frame in the rucksack 10. To this end, a rucksack wall is provided with a reinforcement 91 in the region of the first rotation element 12 and a reinforcement 93 in the region of the second rotation element 13, wherein a further reinforcement 92 is provided in the region of the freely extending bending rod 3. Support straps 94 and closure elements 96 are then provided for further integration. The rucksack opening 95 enables access to the packing volume.

Figure 11:
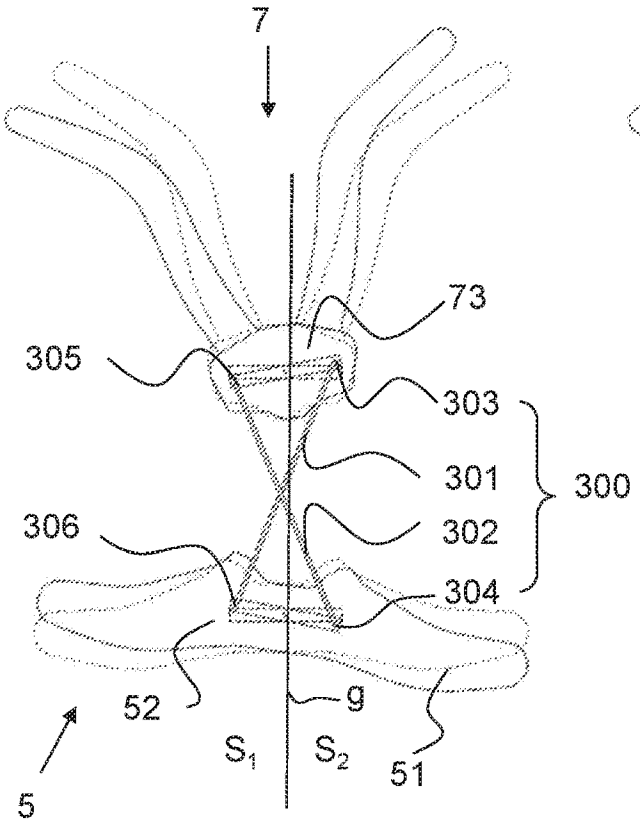
FIG. 11 a support structure according to a further embodiment with an alternative rotational coupling device.
Figure 12:
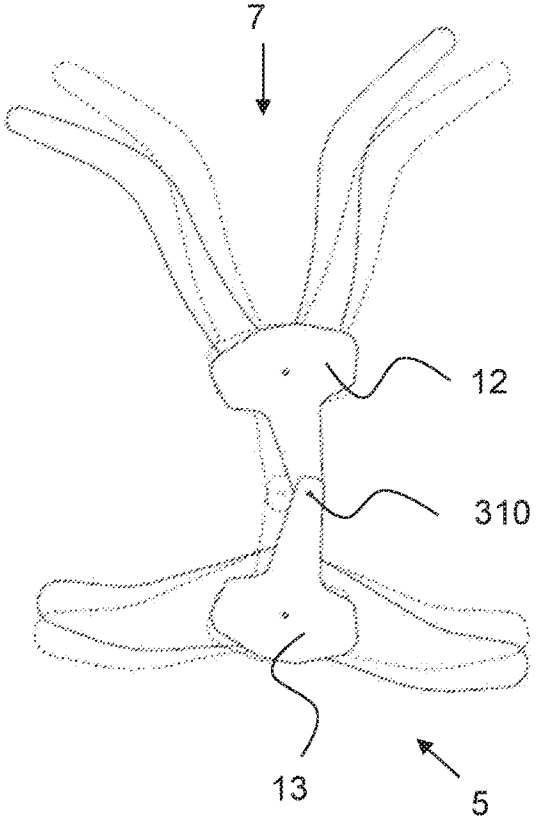
FIG. 12 a support structure according to a further embodiment with a further alternative rotational coupling device.

FIGS. 11 and 12 show alternative rotational coupling devices for coupling the rotation elements 12, 13 in a manner reversing the direction of rotation.

According to FIG. 11, mutually crossing poles or tension cables 301, 302 are provided, which are fastened at fastening points 304 to 306 arranged in opposing pairs on first and second sides $S_1$ and $S_2$ (see FIG. 11) with respect to the straight connecting lines g of the two rotation axes 14, 15. The connecting elements 301, 302 rotationally couple the base plates 53, 73 functioning as rotation elements. A reversal of the direction of rotation occurs as a result of the crossing of the connecting elements 301, 302. The starting position is shown by interrupted lines and the deflected position by continuous lines. Necessary length adaptations can be achieved by flexible connecting elements 301, 302 or by mounting the connecting element 301, 302 in elongated holes.

According to FIG. 12, the finger elements 122, 132 are connected to one another directly via a joint 310. The joint 310 can be formed by a bolt on one finger, which engages in an elongated hole in the other finger element. The shortening of the coupling in the starting position (interrupted lines) compared to the deflected position (continuous lines) can take place as a result of the elongated hole.

The invention claimed is:

1. A support structure for a rucksack having two shoulder belts and two hip belts, the support structure comprising:

a support framework having a first and a second bearing point, wherein the first and second bearing points are arranged at a spacing from one another along a first direction;

a first rotation element being mounted on the support framework at the first bearing point such that it is rotatable about a first rotation axis extending substantially transversely to the first direction; and a second rotation element being mounted on the support framework at the second bearing point such that it is rotatable about a second rotation axis extending substantially parallel to the first rotation axis, a flexible rod being mounted on one of the first and second rotation elements in a fixed manner, wherein the first rotation element is constructed for fastening each shoulder belt extending substantially along the first direction and the second rotation element is constructed for fastening each hip belt extending substantially transversely to the first direction and to the first and second rotation axes, and wherein the flexible rod is mounted on the other of the first and second rotation elements such that it is displaceable along the first direction and fixed transversely thereto.

2. The support structure according to claim 1, wherein at least one of the first and second rotation elements is displaceable along the first direction in various sliding positions for length adaptation of the support structure and can be fixed in place there.

3. The support structure according to claim 1, wherein at least one stop element is provided, which limits a rotation of the first and/or the second rotation elements.

4. The support structure according to claim 3, wherein two stop elements are provided.

5. The support structure according to claim 3, wherein a rotation angle with respect to the straight connecting line through the first and second rotation axes is limited to 15° or less.

6. The support structure according to claim 5, wherein said rotation angle is limited to 10° or less.

7. The support structure according to claim 1, further comprising the two shoulder belts and the two hip belts.

8. The support structure according to claim 1, wherein the flexible rod is constructed in one piece with the one of the first and second rotation element onto which it is mounted in a fixed manner.

* * * * *